United States Patent [19]

Moeller

[11] 4,019,655

[45] Apr. 26, 1977

[54] MECHANICAL DISPENSER

[76] Inventor: Wolfgang W. Moeller, 4 Glen Cove Drive, Glen Head, N.Y. 11545

[22] Filed: Dec. 17, 1975

[21] Appl. No.: 641,710

[52] U.S. Cl. ..... 222/96; 222/101; 222/105

[51] Int. Cl.[2] ..... B65D 35/28

[58] Field of Search ..... 222/96, 101, 102, 105

[56] References Cited

UNITED STATES PATENTS

| | | | |
|---|---|---|---|
| 1,869,685 | 8/1932 | Gusdorf | 222/96 |
| 2,496,004 | 1/1950 | Geyer | 222/102 |
| 3,417,902 | 12/1968 | Mirka | 222/101 X |

*Primary Examiner*—Stanley H. Tollberg
*Assistant Examiner*—Hadd Lane
*Attorney, Agent, or Firm*—Burgess, Dinklage & Sprung

[57] ABSTRACT

A dispenser, especially a dispenser for toothpaste and other paste-like materials and solid substances, comprising a housing and a face plate, the face plate having an openable and closeable aperture therein through which material in said housing is dispensed, the housing having a cover, pivotally connected thereto and carrying an over plate which rideably overlies the face plate. The housing has within it a compressor connected to an engaging means. The engaging means is engaged in a longitudinally disposed track in the housing. The cover bears against an actuating means connected to a transmission which urges the compressor longitudinally within the housing whereby it can engage a container within the housing made of a yieldable material containing material to dispense whereby pressure of the compressor on the yieldable material causes the contents thereof to be dispensed from an opening in the yieldable material.

17 Claims, 18 Drawing Figures

MECHANICAL DISPENSER

BACKGROUND OF THE INVENTION

1. Field of the Invention

This invention relates to a dispenser for solids and paste-like materials. This invention is particularly concerned with a dispenser which houses the actuating mechanism for the dispensing operation and which will dispense the materials in a metered fashion. More especially, this invention is directed to a dispenser which houses tubular and other containers of a yieldable material and keeps the contents thereof free from exposure to the air. This invention is especially concerned with the automated dispensation of paste-like materials in response to the application of pressure to a cover member whereby compression on an interiorly disposed tube causes the contents of said tube to be dispensed through an aperture in the housing of said tube to be dispensed through an aperture in the housing of the dispenser.

2. Discussion of the Prior Art

Numerous dispensers have thus far been provided and these dispensers have included numerous means for dispensing paste-like materials from a tube. For instance, it has been proposed to connect key like mechanisms to the end of a tooth-paste tube whereby the key when rotated takes up the material of the tube thereby creating internal pressure within, e.g., toothpaste tube which in turn causes the toothpaste to be dispensed through the opening in the tube. However, most, if not all of these dispensers suffer from the problem that the amount of paste dispensed from one dispensing operation to another not uniform. Children have a tendency to dispense too much or too little toothpaste, for instance, and thus parents cannot be assured that the proper amount of toothpaste is always employed during a dental prophylactic operation.

In the case of those dispensers which meter the amount of paste the operation has either been frought with mechanical problems or has involved an extensive apparatus of numerous mechanical parts impractical for home use. It therefore became desirable to provide a dispenser particulary useful in the home for the dispensation of paste-like materials. More especially it became desirable to provide a dispenser which could dispense both solid substances such as tablets as well as paste-like materials, e.g., toothpaste. More especially it became desirable to provide an apparatus which had varying apertures in its housing whereby the same apparatus could be used for a number of different tubes of different neck size.

SUMMARY OF THE INVENTION

In accordance with the present invention there is provided a dispenser comprising a housing and a face plate, said face plate having an openable and closable aperture therein through which material in said housing is dispensed, said housing having a cover pivotally connected thereto and carrying an overplate which rideably overlies said face plate, said housing having therewithin a compressor, said compressor having engaging means, said engaging means engaged in a longitudinally disposed track in said housing, said cover bearing on an actuating means, said actuating means connected to a transmission urging said compressor longitudinally within said housing, whereby when it engages a container therein of a yieldable material the contents of said container are caused to be dispensed therefrom.

The present invention has numerous embodiments. In one embodiment the transmission which transmits the motion created by pressure upon the cover to the compressor involves a first rack and a second rack, the racks being in facing relationship with one another and running along a side of the compressor in the direction of travel of the compressor. The first rack is connected to a spring and is biased against the face plate and is movable in the direction of travel of the compressor. The second rack is stationarily secured to the housing and runs longitudinally therewith. These racks can have teeth angularly disposed toward one another and toward the face plate.

In such an instance the actuating means can comprise a lever which is hingedly positioned against the cover on the inside thereof and biased against the spring to which said first rack is connected. The compressor, which is preferably of a cylindrical configuration, has affixed thereto yieldable leaf spring members preferably in the form of a V with the legs protruding away from the aperture in the face plate. The leaf spring members each engage teeth of the racks. An upper leaf spring member engages the stationary rack while the lower leaf spring member engages the reciprocatable rack.

Desirably the actuating means is in the form of a generally inverted U-shaped member. In such an instance there is a second pair of facing racks denominated a third and fourth racks which face one another and have the same relationship to one another as the first and second racks have. The third rack is attached to a spring biased against the face plate while the fourth rack is stationarily disposed within the housing. The third and fourth rack members are disposed on the opposed side of the housing so that the compressor is supported on both sides. Between the third and fourth rack there is disposed a leaf spring member connected to the compressor. The operation of such an apparatus will be described below.

For the purpose of allowing the readjustment of the compressor after it has completed its travel toward the face plate there is provided a slot in the housing running longitudinally in the general direction of the path of travel of the compressor. Passing through the slot there is a connector member connected exteriorly of the housing to a knob. Interiorly the connector has attached thereto a pair of facing U-shaped members engaging the leafs of the leaf spring. Movement of engaging U-shaped members on the leaf spring can cause the same to be depressed whereby they are removed from engagement with the teeth of the facing racks. This permits the entire assembly to be moved rearwardly and positioned for the commencement of a dispensing operation for a completely filled tube.

In another embodiment the actuating means comprises a generally vertically disposed tooth rack having downwardly and angularly directed teeth. A generally longitudinally running rod is positioned within the housing which has toward one end thereof outwardly directed teeth which are engaged by the downwardly and angularly directed teeth of the toothed rack. Coaxially with said rod there are worm gear convolutions which engage the teeth of a sprocketed gear disposed rearwardly in said housing. The sprocketed gear is concentrically attached to a generally cylindrical compressor having on at least one side thereof peripherally running teeth. The peripherally running teeth function as engaging means and are disposed in a longitudinally running track. In such an apparatus there is preferably provided a pair of toothed racks in facing relationship with one another each of which engages its own rod member. The rod members, in turn, engage their own sprocketed gears, these gears being coaxial with a common compressor. The common compressor, in such an instance, has a pair of tracks of peripherally running teeth each member of which engages a separate longitudinally running track.

To provide for the readjustment of the compressor there is provided a longitudinally running cutout through which, as in the case above, passes a connector, connected exteriorly of the housing to a knob member. The interior portion of the connector is connected to a lever which in turn is concentricaly connected to the sprocketed gears through a ratchet mechanism. Movement of the lever by movement through the knob causes the entire compressor mechanism to be worked rearwardly.

To allow for the return of the cover member following its depression during a dispensing operation return springs are provided under each actuating member.

In still a third embodiment of the invention there is provided an apparatus wherein the actuating means comprises a lever pivotally connected to and biased against a spring which in turn is biased against a portion of the housing. The lever is linkagely connected at its other end to a horizontally running reciprocatable toothed rack which forms a portion of the transmission. The transmission further comprises a toothed gear engaging the teeth of a toothed rack. The compressor is cylindrical and is concentric therewith with the toothed gear. The compressor has engaging means in the form of peripherally running teeth which engage a stationarily disposed longitudinally running toothed track. Depression of the spring biased lever causes the horizontally running reciprocatable toothed rack to move the toothed gear which in turn causes the cylindrical compressor to move along a stationarily disposed longitudinally running toothed rack and thereby to depress the contents of a tube disposed within the housing. For the purpose of readjustment of the compressor, the connector member discussed above is similarly provided in this apparatus and the apparatus is characterized by a horizontally running slot in the housing.

In still another embodiment of the invention there is provided an actuating means in the form of a vertically disposed toothed rack against which the covers bears. The toothed rack is in engagement with the teeth of a first circular gear which first circular gear has coaxially thereof a second circular gear. The second circular gear engages an endless belt. The endless belt in turn engages a sprocketed gear coaxially with the compressor which is in the form of a cylinder. The compressor has disposed about its circular periphery sprocket teeth which function an engaging means and the sprocket teeth engage a stationary rack longitudinally disposed in the housing and positioned in the direction of travel of the compressor. In such an instance for the repositioning of the compressor there is again provided a generally elongated cutout in the housing through which passes a connector. The connector in turn is attached such as by a U-shaped engaging member to a ratchet mechanism which is concentric to the toothed gear.

In one phase of the present invention there are provided a number of different embodiments in respect of the aperture mechanism vis-a-vis the overplate. To facilitate the opening of the aperture in one instance there is provided an overplate having an inverted U-shaped configuration which can be either curvilinear or rectilinear. The face plate has an aperture closing overlying the aperture which aperture closing is pivotally connected to the face plate and has tab member extending from the pivot point and functioning as a lever. The tab member is in the path of movement of a leg of the inverted U-shaped overplate. By engagement of the leg with the tab member functioning as a lever, the aperture closing is caused to pivot about the pivot point to thereby be removed from an overlying relationship to the aperture and thereby to permit the contents contained therewithin to be dispensed.

In a second embodiment the aperture has disposed thereover an aperture plate member which is engaged by the overplate. The aperture plate has a cutout and is moveable by engagement with the overplate whereby the aperture plate can be removed from in registry with the aperture to expose the same. In such a case it is preferred that the cover plate have a facing aperture and that the aperture plate be spring biased to permit its return to a position overlying the aperture when the overplate is not in engagement therewith. To facilitate this the aperture plate is rideable within track guides containing springs. Similarly the overplate can have legs therein rideable in guide members.

In still another embodiment facilitating the opening and closing of the aperture there is provided a closure member which overlies the aperture which closure member has an elongated slot therein. The closure member is held to the face plate by at least one pin, preferably a pair of pins in alignment with one another. The closure member is reciprocatingly movable in the direction of the slot. One end of the closure member is engaged by the overplate. This engagement is provided by providing a closure member which is beveled at one end and is engaged by a corresponding beveled edge of the overplate. The continued engagement of the beveled edge of the overplate causes the movable closure member to move in the direction of the slot to thereby expose the aperture. Preferably the closure member is spring biased to permit the closure member to return to a position overlying the aperture when the overplate is not in engagement with the closure member.

In still a further embodiment there is provided over the aperture a pair of pivotally mounted doors each of which is separately pivoted and has a horizontal portion protruding toward the other. Each has a vertical portion which is back-to-back abutment to the vertical portion of the other door. The overplate has a tab member in vertical alignment with the vertical portions of these doors whereby engagement of the tab with the vertical portions of the doors causes the doors to swing apart from one another and to expose the aperture.

The present invention has a number of other significant embodiments or variants. For instance, the dispenser can be made quite attractive for home use by disposing a dressing plate to the cover. This dressing plate can have a decorative design therein. Preferably, it has integrally therewith a portion which overlies the overplate and has an aperture therein in registry with the aperture of the overplate.

The device can further be equipped with a removable block member having different sized collar members for securement to the neck of a tube. These collar members can be removably inserted in a centrally disposed collor holder so that the apparatus can be used for a wide variety of tubes having various sized necks, i.e., neck of various diameters.

As stated above the apparatus of the invention can be used for the dispensation of solids such as tablets, candies or the like. In such an instance it is preferred that the aperture be in the form a pivotally mounted door having a beveled edge engaged by the overplate whereby engagement of the overplate causes the door to pivot about its pivot point whereby the same exposes the contents therewithin. When a solid is dispensed a deformable container within the housing containing the solid is generally employed. Within this container, preferably in the form of a tube, there is a spherical ball member in facing relationship with a block member having an arcuate indent therein. The block member in turn bears against the contents of the tube and causes the same to be urged out when the compressor bears against the spherical member. It is through movement of the compressor that the spherical member bears against the arcuate indent causing uniform motion to be transmitted through the contents of the tube.

Metering of the desired amount of solids is provided by the use of a lever which engages a toothed strip on the inside wall of the cover member.

The invention can be more readily understood and appreciated when reference is made to the accompanying drawings in which.

DESCRIPTION OF SPECIFIC EMBODIMENTS

Figure 1:
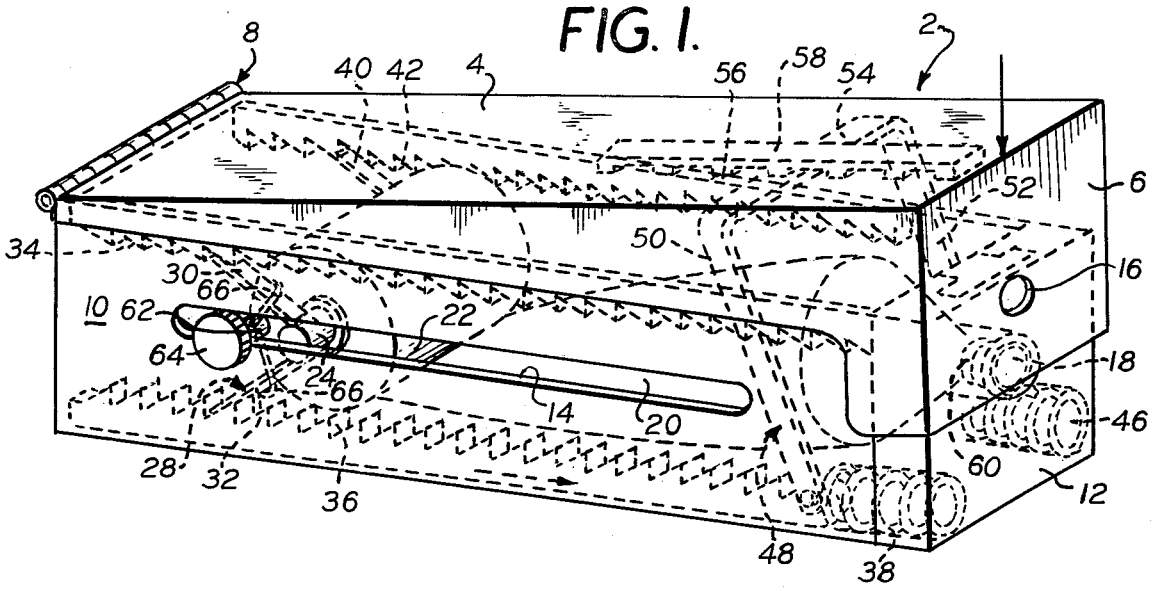
FIG. 1 is a prospective view of an embodiment of the present invention.

Referring to FIG. 1, there is shown an apparatus having a housing 2 comprising a cover 4, an overplate 6 pivotally connected at 8 to a housing body 10 having a face plate 12. A slot 14 is positioned through the housing on either side thereof. The overplate 6 has an aperture 16 therein adaptable to be in registry with an aperture 18 in the face plate 12.

Within said housing there is positioned a tube 20 containing a paste-like material, e.g., toothpaste, grease or the like. This tube does not form part of the apparatus itself, the apparatus being used to dispense the contents of tube 20 through the aperture 18 of face plate 12 and thence through the aperture 16 of over plate 6. To this end there is provided a compressor 22 preferably in the form of a cylinder. The compressor has extension members 24 and 26 which hold leaf spring members. On one side there is provided a leaf spring 28 having leafs 30 and 32. Leaf 30 engages a stationary rack 34 within the housing while leaf 32 engages a reciprocatable rack 36. The reciprocatable rack in turn bears against a spring 38 in turn bearing against face plate 12. Upper leaf 40 on the opposite side of compressor 22 engages a similar rack 42 similar to rack 44. Rack 42 faces a track similar to track 36 (not shown) bearing against a spring 46.

An actuating means is provided in the form of a lever 48 which is preferably in a U-shape having legs 50 and 52 which join to meet a base member 54. The base member is engaged within teeth 56 of a toothed strip 58 secured to the internal wall of the cover 4.

Figure 2:
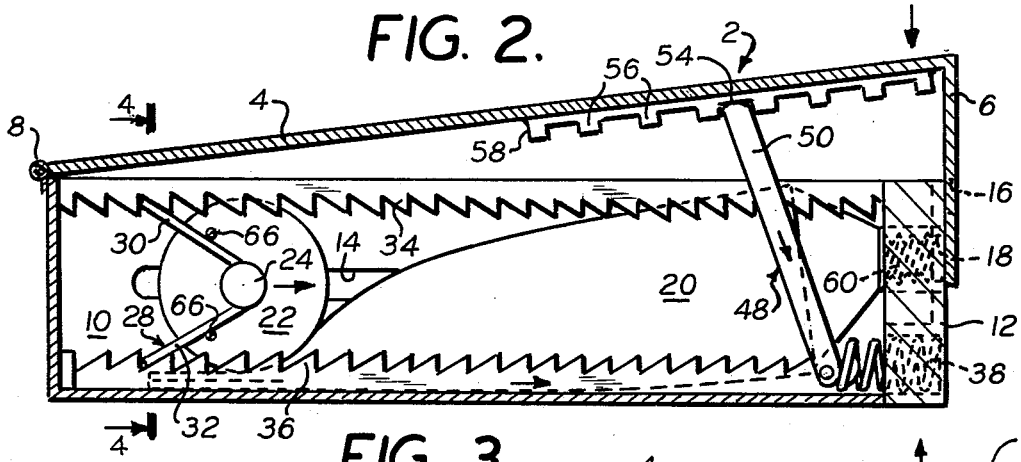
FIG. 2 is a sectional side elevation of the apparatus of FIG. 1.
Figure 3:
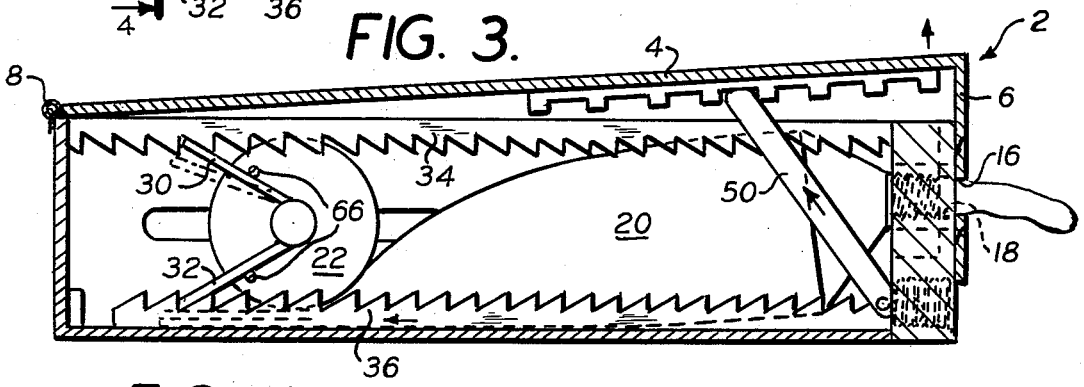
FIG. 3 is a view similar to FIG. 2 showing the disposition of the various parts of the apparatus of FIGS. 1 and 2 during a dispensing operation.
Figure 4:
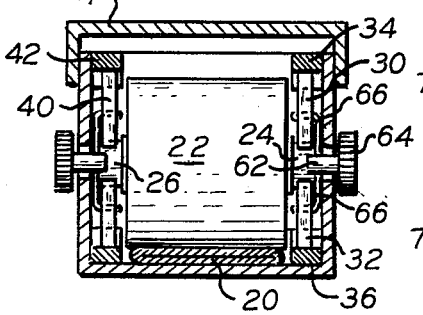
FIG. 4 is a sectional view taken along the lines of FIG. 2.

In operation pressure upon the cover 4 urges the cover 4 down so as to move the aperture 16 in registry with the aperture 18 of the face plate 12. As this is occuring the leg 50 moves toward the springs 38 and causes the rack 36 and the track opposite thereto to move forward. As it moves forward the upper leaf of the leaf spring is caused to advance in the toothed track thereby moving the compressor 22 toward the tube 20 to bear against the contents thereof. This causes the contents to be dispensed through the neck 60 of the tube thence through the aperture 18 and finally through the aperture 16. If the movement of the compressor 22 is not sufficient then pressure on the cover can be released to permit a subsequent dispensing operation. When the pressure on the cover is released the same moves upwardly. This causes the lever 50 to move to the position shown in FIG. 1 whereby the toothed rack 36 returns from the position of FIG. 3 to the position of FIGS. 1 and 2. This, in turn, causes the lower leaf 32 to advance to another forwardly disposed tooth on tooth rack 36. It must be remembered that the same phenomenon occurs on the opposite side of the compressor 22. In this way the compressor 22 in effect walks its way up the teeth of the opposed racks 34 and 36 (as well as the racks on the other side of compressor 22). Depression of the cover will again cause the leg 50 to bear against the spring 38 causing the rack 36 to move forward as shown in FIG. 3. This again causes the leaf member 30 to move one step forward on the rack 34. As this occurs the compressor 22 moves forward and bears against the contents of tube 20 causing the dispensation of content therein.

To permit the return of the compressor mechanism 22 after it has moved completely forward and dispensed all the contents of tube 20 there is provided a slot 14. Passing through slot 14 there is a connector 62 connected exteriorly of the housing to a knob 64. Interiorly there is a pair of facing U-shaped connector wires 66 which ride upon leaf members 30 and 32. By pulling the knob 64 rearwardly the wires 66 are caused to engage a portion of the leaf members 30 and 32 further remote from one another whereby the same become depressed. When they become depressed they are removed from engagement with the teeth of the opposed tracks and thus the entire assembly can be moved rearwardly to a new starting position.

Figure 5:
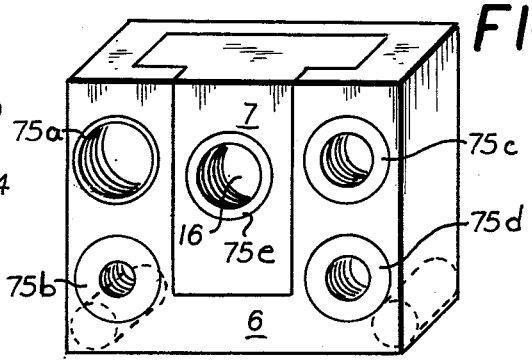
FIG. 5 is a prospective view showing a face plate of the invention containing removable collars for use in a central collar holder.

In FIG. 5 there is shown a variant of the invention wherein the overplate 6 is provided with a collar holder 7 which is removable therefrom. Within collar holder 7 there is the aperture 16 into which is inserted one of the collar holders 75*a-b-c-d-e*. It is noticed that these collar holders have the same outside diameter but a different inside diameter. The purpose for this is to provide a collar holder for insertion in the block 7 so that the neck of the tube can be screwed into the threaded portions of the collar holder 75 securely. The tubes thus far on the market are likely to have the dimensions of one of these collar holders. Thus the neck of the tube can fit securely within one of the collar holders 75*a–e* which can be inserted into the aperture 16. Where the device is to be used subsequently for a tube having a different neck size the particular collar holder 75 is removed from the aperture 16 and the appropriate collar holder is inserted therein.

Figure 6:
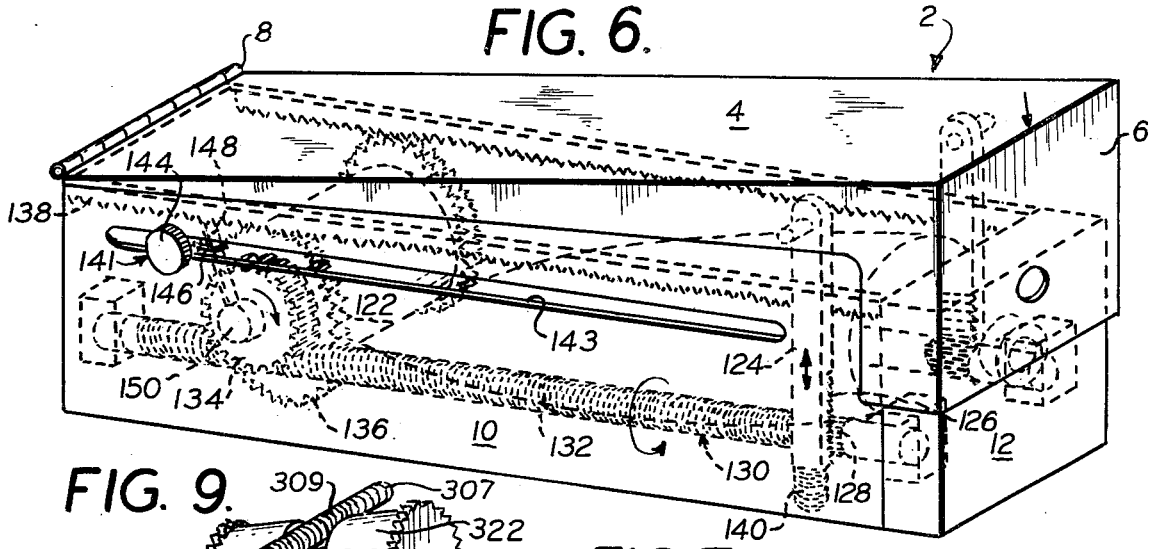
FIG. 6 is a view similar to FIG. 1 showing another embodiment of the invention.
Figure 9:
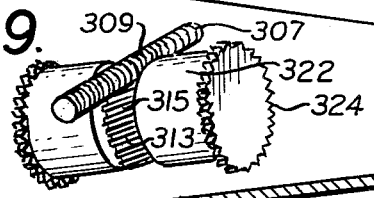
FIG. 9 is a view of a cylindrical compressor engaged by a rod containing worm gear convolutions of the type employed in FIG. 8.

In FIG. 6 there is shown another apparatus of the invention similarly characterized by a housing 2, a cover 4, an overplate 6, a face plate 12, the cover being secured at 8 to the housing. Within the apparatus there is provided a cylindrical compressor 122. The actuating mechanism in this instance comprises at least one toothed rod 124 having angularly and downwardly directed teeth 126 engaged by outwardly extending teeth 128 of a rod 130. Preferably there are a pair of actuating mechanisms which act upon a pair of rods which, in turn, act upon a pair of sprocketed gears coaxial with a common cylindrical compressor. For simplification the description will refer to only one actuating means, rod, sprocketed gear and the like, it being understood that a plurality of the same can be employed and that the operations are synchronous. The rod 130 has worm gear convolutions 132 therein. The worm gear convolutions 132 engage a sprocketed gear 134 towards the rear of the housing. The sprocketed gear 134 is coaxial with the cylindrical compressor 122. For purposes of working its way toward the face plate the cylindrical compressor has sprocketed teeth 136 which engage a generally stationary and longitudinally running track 138. Preferably, the rod 124 is spring biased by a spring 140 to permit its return.

In operation depression of cover 4 causes the rod 124 secured thereto to move directly downwardly and bear against spring 140. When this occurs the downwardly and angularly disposed teeth 126 engage the teeth 128 of the rod 130. This causes the rod 130 to rotate as indicated. Rotation of this rod in turn causes the sprocketed gear 134 to rotate as indicated causing movement of the coaxial cylindrical compressor 122. This compressor is free to ride on the stationarily disposed longitudinally running track 138 to move in advancement toward the tube disposed therewithin to compress the compress the same as in the embodiment of FIGS. 1–3. When the dispensing operation is over the pressure is released. Because of the shape of the teeth the teeth 126 do not engage teeth 128 and thus the entire transmission is not rotated in the opposite direction and the compressor 122 is not caused to move rearwardly. Thus the compressor 122 remains in position for a subsequent operation, i.e., it remains in partially overlying relationship to the tube therewithin so that the contents thereof are readily dispensed by the application of one stroke to the cover 4.

To permit the readjustment of the compressor 122 there is provided a connector 141 passing through a slot 143 running longitudinally within the housing. The connector is connected to a knob 144 exteriorly of the housing. Interiorly of the housing the connector 141 is connected to a U-shaped wire member 146 which engages a lever 148 which is connected to the sprocket gear 134 via a ratchet mechanism 150. The compressor can be readjusted to a rearward position by a ratchet action upon the sprocket gear 134. The operation resembles the operation of a ratchet wrench whereby by rearward mechanism of the movement of the lever the compressor is urged rearwardly. Motion of the lever 148 forward does not cause the compressor 122 or the gears coaxially therewith to move forward.

Figure 7:
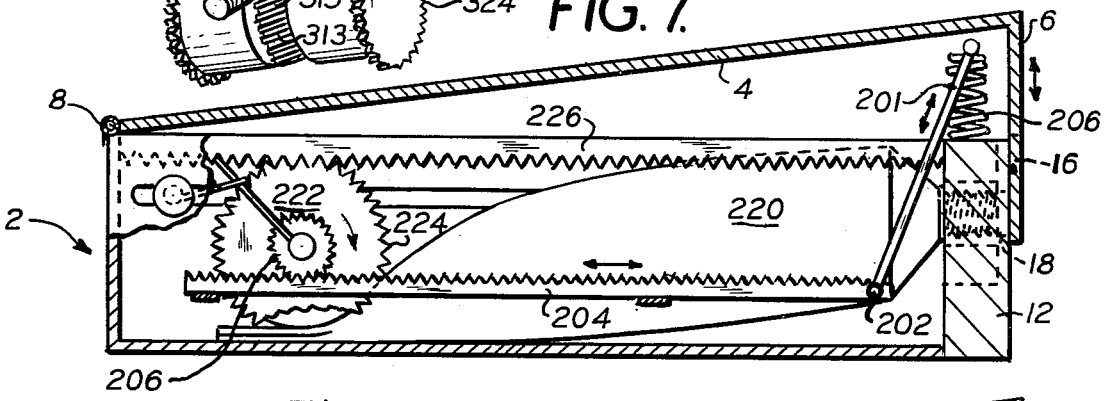
FIG. 7 is a view similar to FIG. 2 showing still another embodiment of the invention.

Referring to FIG. 7 there is shown another embodiment. Here, again, there is provided a cover 4, an overplate 6 overlying a face plate 12, the cover being connected at pivot point 8 to a housing 2. Within the housing there is provided a lever 201 linkagely connected at 202 to a horizontally reciprocatable rack 204. The lever 201 bears against a spring 206 which in turn bears against a portion of the body of the face plate 12. The rack 204 engages a sprocketed gear 206. The sprocketed gear 206 is coaxial with a cylindrical compressor 222 similarly provided with arcuately running teeth 224. These arcuately running teeth 224 are in engagement with the teeth of a sprocketed track 226. The apparatus is also provided with a means to return the cylindrical compressor 222 to its original position. The mechanism by which this is accomplished is analagous the mechanism shown in FIG. 6.

In the operation of the apparatus of FIG. 7 compression of the cover 4 causes the lever 201 to move rearwardly. This causes the rack 204 to move rearwardly which in turn causes the gear 206 to rotate in the direction indicated. This in turn moves the coaxial cylindrical compressor 222 forward toward the tube 220 therewithin to cause the contents to pass in its travel during operations through the aperture 18 and thence through the aperture 16 in the face plate 6.

When the cover plate is released the lever 201 moves upwardly thereby allowing the horizontal rack 204 to move forwardly. This does not adversely affect the relationship of the toothed gear 206 inasmuch as it is connected to the cylindrical compressor 222 by a ratchet-like mechanism. Therefore the gear 206 is caused to rotate but the rotation is free with respect to the cylindrical compressor 222 and the same remains in the position on the sprocketed 226.

Figure 8:
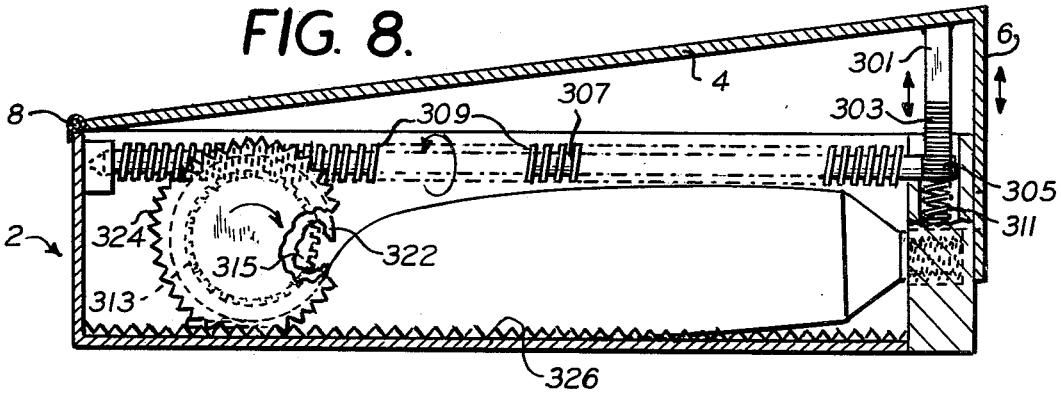
FIG. 8 is a view similar to FIG. 7 showing still another embodiment of the invention.

In FIG. 8 still another embodiment of the invention is shown. In this embodiment a cover 4 is connected to a face plate 6 and is pivotally connected at 8 to the housing 2. Within the housing there is provided an actuating means in the form of a strip 301 having gear teeth 303 therewithin. Gear teeth 303 in turn engage teeth 305 of rod 307. Rod 307 has worm gear convolutions 309 on the side thereof. The strip 301 is biased against a spring 311 to permits it return following a dispensing operation. The worm gear convolutions 309 are engaged within the teeth 313 of a sprocketed gear 315. This gear is coaxial in the manner of FIG. 7 with a cylindrical compressor 322 having exteriorly disposed teeth 324. These teeth in turn are in engagement with the teeth of a stationary and horizontally running toothed track 326.

In operation when the cover 4 is depressed the teeth 303 engage the teeth 305 causing the rod 307 to rotate as indicated. When this rotation occurs the worm convolutions 309 engage the teeth 313 of the sprocketed gear 315 as the spring 311 is depressed beneath the strip 301. The engagement of the teeth causes the gear 315 to rotate thereby rotating the coaxial cylindrical compressor 322 and causing the same to move forward along the longitudinal track 326. When the dispensing operation is completed the pressure is released allowing the spring 311 to cause the strip 301 and cover 4 to return to their original position. Since the teeth 303 are in only one relationship to the teeth 305 rerotation of the rod 307 is not possible. This follows the same principal as the embodiment of FIG. 6.

Figure 10:
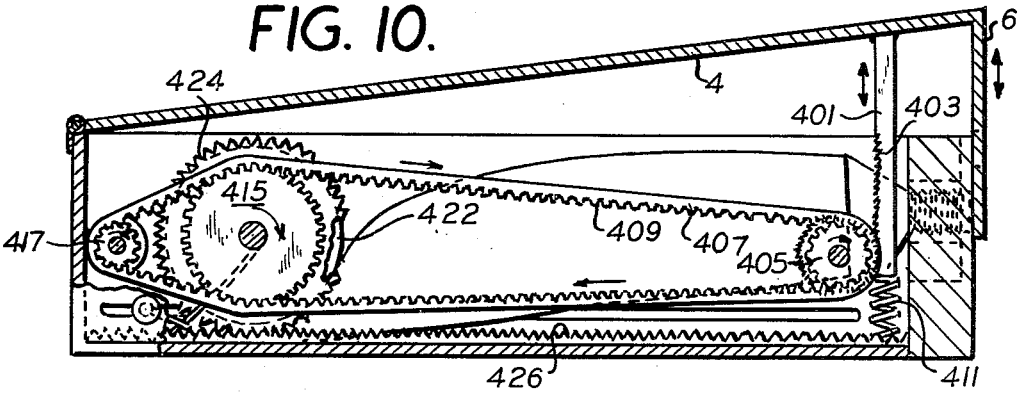
FIG. 10 is a view similar to FIGS. 2, 3, 7 and 8 showing still another embodiment of the invention.

Referring to FIG. 10 there is shown an embodiment involving the use of an endless belt. In this embodiment a toothed strip 401 is provided having teeth 403. These teeth engage a first gear member (not shown) located coaxial with a second gear 405. The gear not shown and second gear 405 are coaxial with one another. Gear 405 has teeth disposed thereabout which engage an endless belt 407. The endless belt can be a simple belt or can be in the form of a chain such as a sprocketed chain or the like. Preferably the belt is a toothed belt having teeth 409 as shown.

The strip 401 has disposed therebeneath a spring such as a coil spring 411 to permit its return following a dispensing operation. The teeth 409 of the endless belt 407 engage at least one gear 415. Preferably they also engage the teeth of an idler gear 417. The gear 415 is coaxial with a cylindrical compressor 422 which, as in the embodiment shown in FIGS. 6, 7 and 8, is provided with sprocketed teeth 424 running about the circular periphery thereof. Within the housing there is disposed a horizontally running track 426 having teeth which are engaged by the teeth 424 of the cylindrical compressor 422.

In operation depression of the strip 401 causes the teeth 403 to engage a first circular gear (not shown) coaxial with the second gear 405. This causes movement of the endless belt 407 as shown. This, in turn, causes the gear 415 to rotate which in turn effects rotation of the cylindrical compressor 422. This compressor in turn is caused to work its way by virtue of its engagement with the teeth of the horizontally running track 426. When the dispensing operation is complete the pressure on the cover 4 is released thereby allowing return spring 411 to dispose the cover and strip 401 into the original position. Here again the belt is not caused to rotate in the opposite direction because of the nature of the teeth 403, i.e., they engage only in one direction. The engagement of teeth 403 with a circular gear not shown is similar to the engagement shown in FIG. 6.

Figure 11:
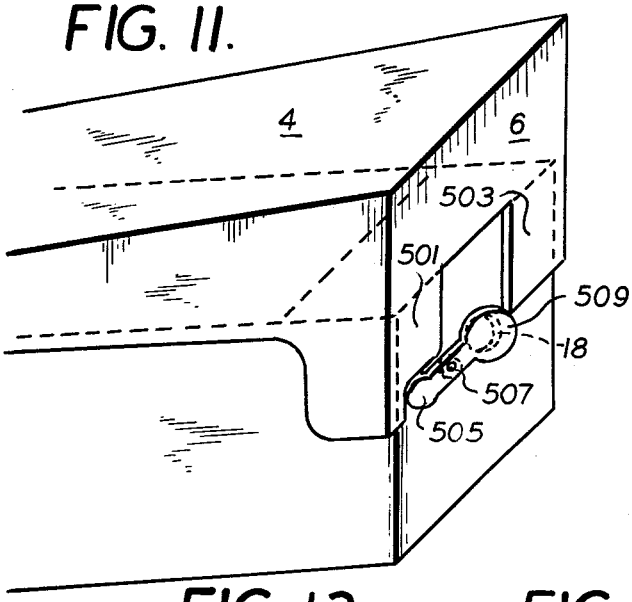
FIG. 11 is a prospective view of the front portion of a dispenser of the invention showing an aperture closure member in relationship to the face plate and overplate.
Figure 12:
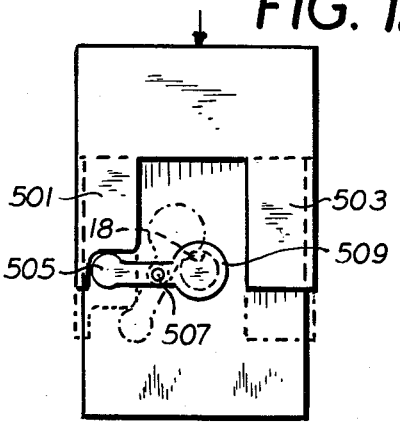
FIG. 12 is a side elevation of the apparatus of FIG. 11 showing in phantom the disposition of the closure member.

Referring to FIG. 11 there is shown one means by which the aperture 18 can be exposed during a dispensing operation. In this instance the cover plate 6 has a generally inverted U-shaped configuration and therefore has legs 501 and 503. Disposed over the aperture 16 is an aperture closing member comprising a tab member 505 pivotally connected at 507 to a cover 509. In operation as the cover 4 is depressed the leg 501 engages tab 505 causing the cover 509 to pivot as shown in phantom in FIG. 12 thereby exposing the aperture 18.

Figure 13:
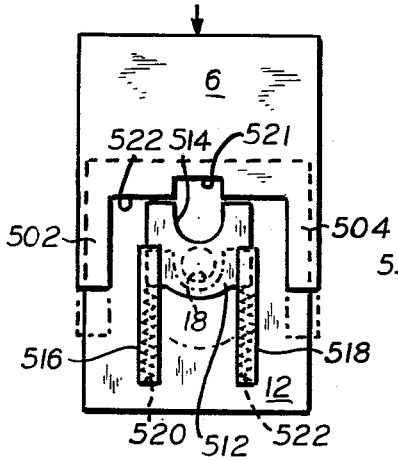
FIG. 13 is a view similar to FIG. 12, partially in phantom showing still another embodiment of the invention.

In FIG. 13, there is shown another embodiment. Here the overplate 6 is preferably provided with leg member 502 and 504 although these leg members do not play a roll in the actual exposure of the aperture. Over the aperture 18 there is an aperture plate 512 which has a U-shaped cutout 514. The aperture plate 512 is preferably rideable in guides 516 and 518 each of which contain springs 520 and 522. Thus the aperture plate 512 is movable with respect to the face plate 12. The overplate 6 can similarly have a cutout of U-shape or rectangular shape 521.

In operation when the leading edge 522 of the overplate 6 engages an edge of the aperture plate 512 the aperture plate 512 is caused to ride in the guides 516 and 518 and bear against the springs 520 and 522. Since there is a U-shaped cutout 514 in the aperture plate 512 the aperture 18 will be exposed when the aperture plate 512 travels the defined distance. When the overplate 6 is released from engagement with the aperture plate 512 the springs 520 and 522 will dispose the aperture plate 512 over the aperture 18 whereby to close the same.

Figure 14:
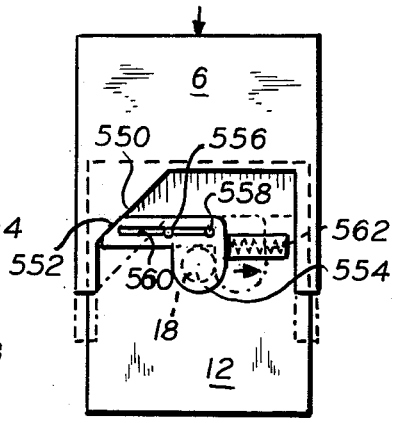
FIG. 14 is a view similar to FIGS. 12 and 13, partially in phantom, showing still another embodiment of the invention.

In FIG. 14 there is shown still another embodiment for this opening and closing operation. According to FIG. 14 there is provided the same overplate 6 overlying the face plate 12. The overplate 6 has a beveled portion 550 which engages the beveled portion 522 of a closure member 554. The closure member 554 is rideable over the face plate 12 and is secured thereto by virtue of pins 556 and 558. A slot 560 is provided to allow lateral movement of the closure member 554. A spring 562 is provided.

In operation when the cover plate 6 is moved downwardly the beveled edge 550 meets the corresponding beveled edge 552 of the closure member. This causes the same to move laterally within the slot 560 and for its edge to bear against the spring 562. As this operation continues the closure member 554 is caused to be disposed out of alignment with the aperture 16 whereby it opens the same. When the cover member 6 is released from engagement with the beveled edge 552 of the closure member 554 the spring 562 acts to dispose the closure member 554 over the aperture 16.

Figure 15:
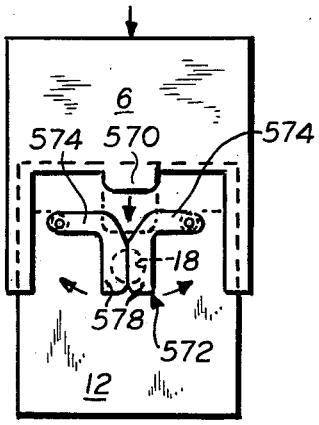
FIG. 15 is a view similar to FIGS. 12–14, partially in phantom, showing still another embodiment of the invention.

In FIG. 15 there is shown still another embodiment. In this embodiment the overplate 6 is provided with a tab 570 in general alignment with a pair of doors 572 each comprising a horizontal portion 574 pivotally connected to the face plate 12. These doors extend toward one another and have vertical portions 578 in back-to-back relationship. In operation as the tab 570 engages the vertical portions 578 the entire doors are caused to swing about the pivot points to thereby expose aperture 18.

Figure 16:
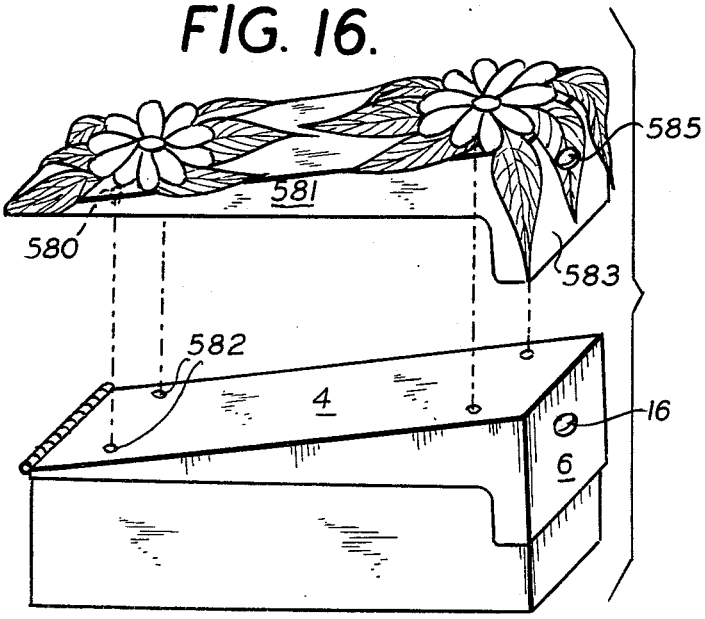
FIG. 16 is an exploded prospective view of an embodiment of the invention wherein a decorative dressing plate is detachably secured to a cover plate.

In FIG. 16 there is shown a decorative dressing plate provided with resilient tabs 580 for engagement in corresponding apertures 582 in the cover 4. Preferably the dressing plate 581 is provided with an integral dressing overplate 583 which can be disposed over the overplate 6. If the mechanism has an aperture 18 in the overplate 6 a corresponding aperture 585 is provided in the dressing overplate 583.

Figure 17:
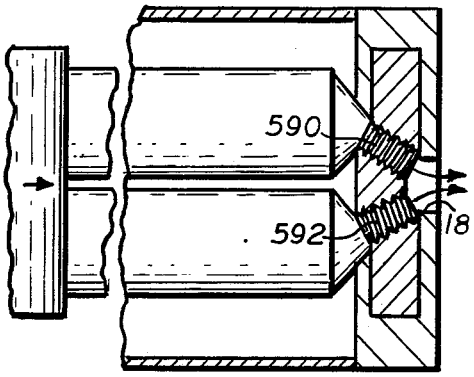
FIG. 17 is a sectional elevation of a portion of a dispenser of the invention showing a plurality of channels through the face plate for use in those embodiments where two or more tubes are employed, the channels being joined at the exterior of the aperture.

In the cross-sectional view of FIG. 17 there is shown how the apparatus is fitted for two tubes. In such an instance angularly disposed channels 590 and 592 are employed which meet at the aperture 18. The tubes can be aligned with these channels 590 and 592 within the housing tube.

Figure 18:
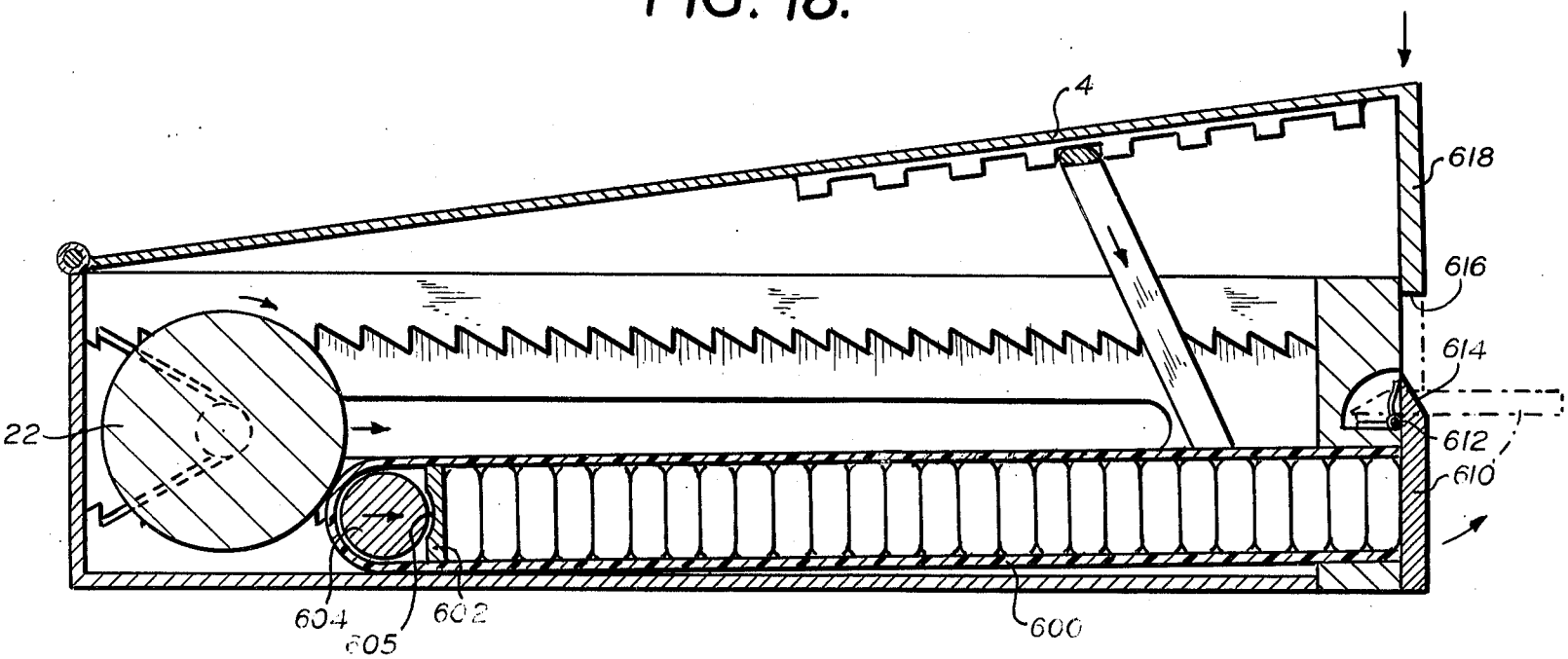
FIG. 18 is a view similar to FIGS. 2, 3, 7, 8 and 10 showing an apparatus of the invention for use in the dispensation of solids.

In FIG. 18 there is shown the apparatus as employed for the dispensation of solids. The transmission mechanism actuating means, housing and the like are identical to that shown in FIGS. 1–3. The principal difference lies in the fact that the solids are disposed within a yieldable material 600 suitably of an elastomeric material. Within the yieldable material there is provided a block member 602 which extends through the entire cross section of the tube. Member 602 is engageable with a spherical member 604 contained within the tube. The cylindrical compressor 22 engages the spherical member 604 through the material of the inner container 600 and causes the sphere 604 to engage within the arcuate indent 605 of the block member 602. This causes the entire contents to be moved in the direction of the aperture.

In FIG. 18 the aperture for dispensation of the solids comprises a pivotally mounted door 610 pivoted at 612. Commencement of this pivoting operation is provided by virtue of providing a beveled edge 614 integral with the door 610 which can be engaged by the leading edge 16 of the overplate 618. The movement of the door is shown in phantom in FIG. 18.

The device of FIGS. 1–3 and 18 is characterized by a strip disposed against the inner surface of the corner 4. This strip engages a lever as shown in the respective figures. The lever can be moved from one tooth spacing to another. By doing this the amount of material discharged in a given dispensing operation is adjusted. Obviously, if the lever is moved toward the overplate it will move a greater distance during a dispensing operation and more material will be discharged. Conversely, if the lever is disposed within the rearmost tooth it will move the least thereby dispensing a correspondingly lower amount of material.

It will be apparent from the foregoing that the present invention is useful in the dispensation of a wide variety of material from a wide variety of consistencies. It can be used in the dispensation of creams, pastes, thixotropic materials or virtually any flowable material, especially those having a solid-liquid consistence. It is useful for dispensation of solids particularly those things in tablet form. It is useful for dispensation of pills, tablets and other medicines as well as candies of the sugar-coated type including sugarcoated gum products and the like.

What is claimed is:

1. A dispenser comprising a housing and a face plate, said face plate having an openable and closable aperture therein through which material in said housing is dispensed, said housing having a cover pivotally connected thereto and carrying an overplate which ridably overlies said face plate, said housing having therewithin a compressor, said compressor having engaging means, said engaging means engaged in a longitudinally disposed track in said housing, an actuating means connected to said cover and connected to a transmission for urging said compressor longitudinally within said housing; whereby when it engages a container within said housing of a yieldable material containing material to be dispensed, said material is dispensed, said transmission comprising a first rack and a second rack, said first rack facing said second rack, said first and second racks running along a side of said compressor in the direction of travel of said compressor, said first rack being connected to a spring biased against said face plate and being movable in the direction of travel of said compressor, said second rack being stationarily secured to said housing and running longitudinally therewith; said actuating means comprising a lever hingedly positioned against said cover on the inside thereof and biased against said spring, said first and second racks engaged by a yieldable leaf spring attached to said compressor.

2. A dispenser according to claim 1 wherein said transmission further comprises a third rack and a fourth rack, said third rack facing said fourth rack, said third and fourth racks running along a side of said compressor opposite the side where said first and second racks run in the direction of travel of said compressor, said third rack being connected to a spring biased against said face plate, said fourth rack being stationarily secured to said housing and running longitudinally therewith, said actuating means comprising a generally U-shaped configuration, the legs of said U-shaped lever engaging said springs which bear against said face plate, the apex of the U-shaped lever engaging a toothed strip positioned against said cover in facing relationship to said housing.

3. A dispenser according to claim 1 wherein along at least one side of said housing and running in the direction of travel of said compressor there is a generally elongated cutout through which passes a connector, said connector having a knob member attached at its end exterior of said cutout, said knob overlying said cutout, said connector having arms connecting the leaf of said leaf spring.

4. A dispenser according to claim 1 wherein said leaf spring is generally V-shaped with the nadir of the spring engaged at a lateral edge of said compressor at the center thereof, and the legs of said V-shaped leaf spring are engaged in teeth of said first and second racks rearwardly of said compressor, the teeth of said first and second racks being generally inclined toward said apertures.

5. A dispenser according to claim 1 wherein said overplate has an inverted U-shaped configuration which is curvilinear or rectilinear, said face plate has an aperture closing overlying said aperture which closing is pivotally connected to said face plate and has a tab member exteriorly from the pivot point, said tab member being in the path of movement of a leg of said U.

6. A dispenser according to claim 5 wherein said aperture plate is rideable in a pair of tracks.

7. A dispenser according to claim 6 wherein said aperture plate is spring biased in said tracks.

8. A dispenser according to claim 1 wherein said aperture has disposed thereover an aperture plate member having engaged by said overplate, said aperture plate having a cutout, said aperture plate being movable by engagement with said overplate whereby said aperture plate is removed from in registry with said aperture to expose the same.

9. A dispenser according to claim 8 wherein said overplate has a cutout in facing relationship to the cutout in said aperture plate.

10. A dispenser according to claim 1 wherein overlying said aperture there is a closure member said closure member having a longitudinal slot and being held to said face plate by pin members passing through said slot, said closure member being reciprocatingly movable in the direction of said slot, one end of said closure member being engaged by said overplate.

11. A dispenser according to claim 10 wherein the end of said closure member engaged by said overplate is beveled and is engaged by a correspondingly beveled edge of said overplate.

12. A dispenser according to claim 11 wherein said closure member is spring biased.

13. A dispenser according to claim 1 wherein over said aperture there are a pair of pivotally mounted doors each of which is separately pivoted and has a horizontal portion protruding toward the other and a vertical portion in back-to-back abutment to the vertical portion of the other door and said overplate has a tab in vertical alignment with the vertical portions of said doors whereby engagement of said tab with said vertical portion causes said doors to swing apart from one another and exposed said aperture.

14. A dispenser according to claim 1 wherein to said cover there is detachably secured a dressing plate which overlies the same.

15. A dispenser according to claim 14 wherein said dressing plate overlies said overplate and has an aperture therein in registry with an aperture in said overplate.

16. A dispenser according to claim 1 wherein there are a pair of apertures through said face plate which are angularly disposed from one another and meet on the exterior side of said face plate.

17. A dispenser according to claim 1 wherein said face plate comprises a pivotally mounted lever having a beveled edge, said beveled edge engageable by said overplate to swing said lever open.

* * * * *

UNITED STATES PATENT AND TRADEMARK OFFICE

CERTIFICATE OF CORRECTION

PATENT NO. : 4,019,655

DATED : April 26, 1977

INVENTOR(S) : Wolfgang W. Moeller

It is certified that error appears in the above-identified patent and that said Letters Patent are hereby corrected as shown below:

Column 3, line 17, "concentricaly" should read -- concentrically --.

Column 3, line 59, "an" should read -- as --.

Column 5, line 3, "collor" should read -- collar --.

Column 10, line 1, "a" should read -- the --.

Column 11, line 39, "corner" should read -- cover --.

Column 11, line 55, "consistence" should read -- consistency --.

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*